US006200410B1

(12) United States Patent
Kukoff

(10) Patent No.: US 6,200,410 B1
(45) Date of Patent: Mar. 13, 2001

(54) DECORATIVE GLITTERED ARTICLES AND METHOD OF MAKING SAME

(75) Inventor: Michael L. Kukoff, 34 Addison Dr., Short Hills, NJ (US) 07078

(73) Assignees: Michael L. Kukoff, Hillside; Jay J. Kukoff, Springfield, both of NJ (US); part interest to each ( * ) Notice: Subject to any disclaimer, the term of this patent is extended or adjusted under 35 U.S.C. 154(b) by 0 days.

(21) Appl. No.: 09/334,370

(22) Filed: Jun. 16, 1999

(51) Int. Cl.[7] ..... B65C 11/06

(52) U.S. Cl. ..... 156/320; 156/72; 156/325; 427/448; 427/487; 427/375; 427/372.2; 427/208.2

(58) Field of Search ..... 428/15, 17, 7, 428/195, 200, 212, 537.5, 915, 916; 156/60, 63, 72, 279, 278, 320, 325; 427/448, 475, 487, 532, 565, 208.2, 355, 372.2, 375

(56) References Cited

U.S. PATENT DOCUMENTS

| | | | | |
|---|---|---|---|---|
| 4,769,265 | * | 9/1988 | Coburn, Jr. | 428/40 |
| 5,294,657 | * | 3/1994 | Melendy et al. | 524/270 |
| 5,634,318 | * | 6/1997 | Weder | 53/397 |
| 5,701,720 | * | 12/1997 | Weder | 53/397 |
| 5,985,380 | * | 11/1999 | Weder | 428/15 |

* cited by examiner

*Primary Examiner*—Merrick Dixon
(74) *Attorney, Agent, or Firm*—Kirschstein, et al.

(57) ABSTRACT

A light-reflective decorative glittered article is made by coating a light reflective foil with a powdered resin, fixing the resin, cutting the coated foil into glitter flakes, flocking the flakes onto a curable adhesive applied on areas of a base material to be decorated, and curing the adhesive while concomitantly causing the resin on contacting flakes to become tacky Scattering and fall-off of the flakes during manufacture are reduced.

9 Claims, 1 Drawing Sheet

DECORATIVE GLITTERED ARTICLES AND METHOD OF MAKING SAME

FIELD OF THE INVENTION

This invention generally relates to decorative articles having light-reflecting glitter flakes thereon and, more particularly, to making such articles with fully glittered areas.

DESCRIPTION OF THE RELATED ART

It is known from U.S. Pat. No. 3,377,184 to apply a tacky adhesive, preferably a polyvinylchloride plastisol, to a base fabric material in a desired pattern, and thereupon to apply or flock a plurality of bead-like pieces or particles of synthetic plastic material onto the tacky adhesive. The excess particles are then removed. The adhesive is cured by being heated. The plastic particles are thus fixedly set on the fabric material. The plastic particles actually melt slightly during the curing and fuse with the adhesive. The adhesive may be applied thicker or thinner depending on its proposed use; see, for example, U.S. Pat. No. 3,582,440.

It is also known from U.S. Pat. No. 3,806,397 to apply a multitude of light-reflective flakes (also known as "glitter") onto such an adhesive which has been applied to a release paper material. Each flake has an aluminum core which is coated over its entire periphery with a thin layer of a transparent polyvinylchloride. To cure the adhesive, heat is applied thereto and to the flakes on the adhesive. During this heating step, the transparent layer of polyvinylchloride that coats the flakes melts slightly and fuses with the adhesive. The flakes being essentially two-dimensional, planar and thin, e.g., on the order of 4 mils, lay flat against the release material.

It is further known from U.S. Pat. No. 5,597,434 and U.S. patent application Ser. No. 08/741,815, filed Oct. 31, 1996, now allowed, to place a foil sheet over a plurality of discrete shaped plastic particles or beads and to fix portions of the foil sheet on upper surfaces of the particles. Thereupon, the foil sheet is peeled off the particles, leaving behind the fixed foil sheet portions which act as an irregular light-reflective surface.

Although generally satisfactory for their intended purpose, the known processes of making a light-reflective, decorative article require a great quantity of coated light-reflective flakes to be manufactured and used. The flakes tend to scatter away from one another and to fall off the base material during flocking. This leads to a sparse coverage of the flakes on areas of the adhesive to be decorated by glittering. Also, since the transparent coatings melt to different extents during curing of the adhesive, the light-reflective characteristics, as well as the adhesion force, of the flakes vary. It is difficult to predict and/or control such variations, thereby leading to non-uniform production of the decorative articles.

SUMMARY OF THE INVENTION

Objects of the Invention

It is a general object of this invention to provide a novel method of making a light-reflective decorative article with fully glittered areas.

Another object of this invention is to decorate an article, such as a fabric, with light-reflective glitter flakes while avoiding the aforementioned difficulties and drawbacks of the prior art.

Still another object of this invention is to make a relatively lightweight material having a light-reflective characteristic that can readily be used in wearing apparel.

Yet another object of this invention is to make a light-reflective decorative article that can be folded, cut, rolled, sewn, draped and washed with ease, without the light-reflective glitter flakes falling off the article during such procedures.

An additional object of this invention is to provide a light-reflective fabric from which the light-reflective glitter flakes will not fall off, especially when worn.

Another object of this invention is to provide a decorative article whose areas to be glittered are fully covered.

Features of the Invention

In keeping with these objects and others which will become apparent hereinafter, one feature of this invention resides, briefly stated, in a method of making a light-reflective decorative article with fully glittered areas, which comprises the steps of coating a light-reflecting foil with an adhesive substance; fixing the adhesive substance on the foil to form an adhesive-coated foil; and forming the adhesive-coated foil into a multitude of glitter flakes.

The method further includes the steps of applying a curable adhesive in a predetermined pattern on areas of a base material to be glittered, depositing the glitter flakes onto the areas of the base material, and curing the curable adhesive with heat and concomitantly causing the adhesive substance on mutually contacting flakes to become tacky and adhere the mutually contacting flakes to one another.

Thus, in accordance with this invention, it is no longer necessary to use a great quantity of light-reflective flakes because the flakes adhere to one another. The production of such decorative articles is more uniform than heretofore. The decorative articles have a richer, fuller appearance. There is a decreased tendency for the flakes to fall off during use or washing.

In the preferred embodiment, at least one surface, if not both surfaces, of the foil are coated with a particulate adhesive substance, such as a powdered resin. The resin is heated sufficiently so that it flows and solidifies in situ on the foil, prior to cutting the foil into the multitude of glitter flakes.

The curable adhesive is preferably a layer of a tacky polyvinylchloride plastisol onto which the flakes are flocked. When the plastisol is cured, by the application of heat, the flakes not only adhere to one another as described above, but also adhere to the cured plastisol.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
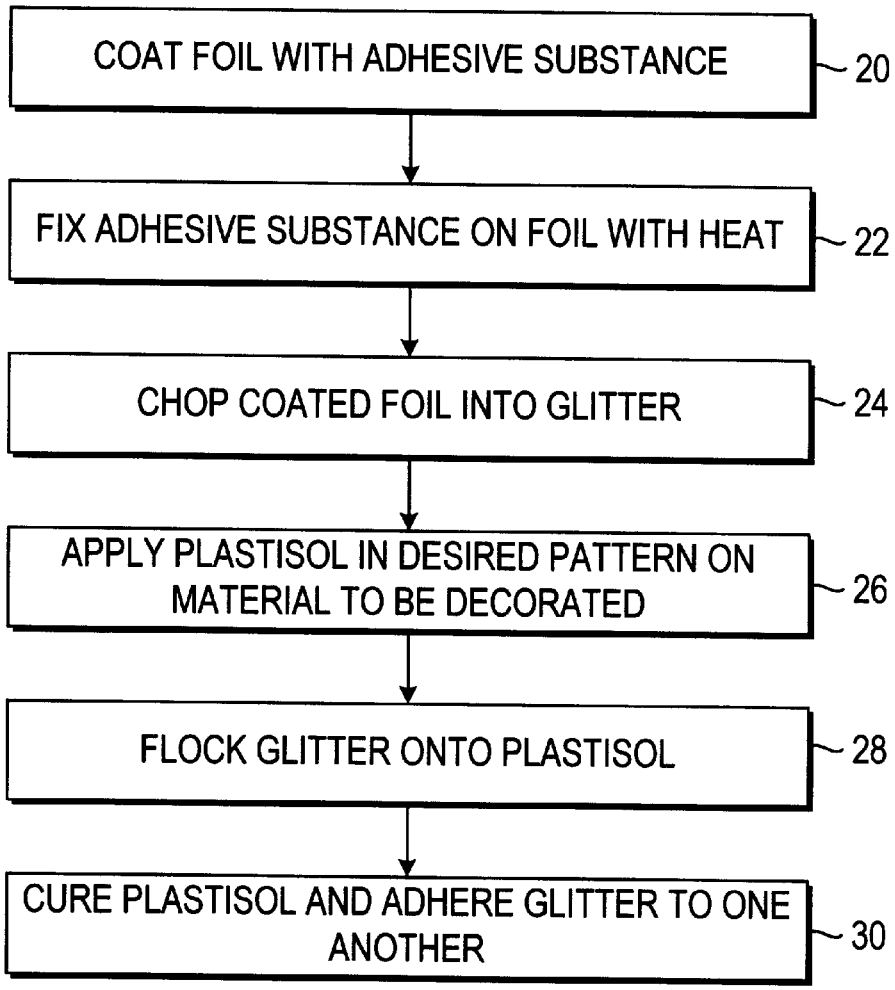
FIG. 1 is a flow chart of the method of making a glittered article in accordance with this invention.
Figure 2:
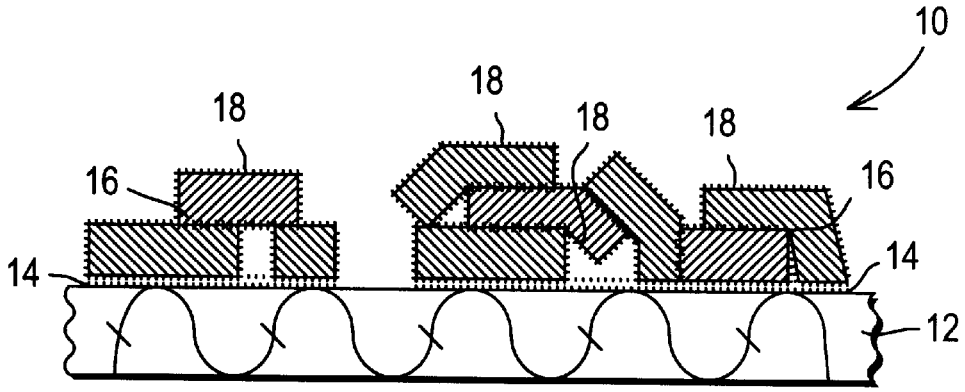
FIG. 2 is an enlarged sectional view of a light-reflective decorative glittered article made in accordance with FIG. 1.

Referring now to the drawings, reference numeral 10 in FIG. 2 shows a light-reflective decorative article manufactured in accordance with this invention. The steps of the manufacturing method are shown in the flow chart of FIG. 1.

The article 10 comprises a base material or layer 12. Advantageously, the base layer 12 is a fabric, either woven or non-woven, stretchable or non-stretchable, and preferably made from natural fibers, synthetic fibers, or combinations thereof. Preferably, the fabric is readily rolled, cut or sewn, so that it can be used for such applications as clothing, handbags, shoes, scarves, etc. The base layer could also be a release layer, such as paper, either coated or uncoated with a release coating.

A layer of an adhesive 14 is applied over the base layer 12 in any desired pattern or design. Preferably, the adhesive is a curable plastisol which is applied in a liquid state to the base layer 12, either by hand or through a sieve, stencil, screen or analogous pattern-forming device to obtain the desired pattern. The wet adhesive penetrates slightly among the interstices of the base layer 12.

Basically, the plastisols are composed of vinyl chloride resin particles dispersed in a plasticizer to which may be added stabilizers, pigments, gelling agents, mineral spirits (for thinning) and similar modifying additives. The formulation of plastisols usable with the present invention is quite wide. For example, based upon 100 parts by weight of vinyl chloride resin, the amount of plasticizer may vary from 50 parts to 200 parts and the amount of pigment, stabilizers and/or other modifying components may vary between 0 and 10 parts.

Typical examples of plastisols which may be used with the present invention are as follows:

| Plastisols | Pounds |
|---|---|
| (1) | |
| Polyvinylchloride resin (QYNV) | 100 |
| Diisooctylphthalate | 80 |
| Dibutyl tin maleate | 1 |
| (2) | |
| Polyvinylchloride resin (Geon 121) | 100 |
| Dioctylphthalate | 80 |
| Barium-cadmium laurate | 1 |
| (3) | |
| Polyvinylchloride resin (Exon 654) | 100 |
| Tri cresyl phosphate | 80 |
| Tri basic lead stearate | 2 |

Plastisols made according to the above formulations have the characteristics of pliabilty, flexibilty and softness rather than the stiffness and hardness of other types of adhesives. They may be readily cut or sewn and then can withstand repeated washing or dry cleaning and have good, long-lasted wearing characteristics. If desired, these plastisols may contain pigmentation and may be thinned by mineral spirits. In this matter, the polyvinylchloride may be thinned to be free flowing for a flat appearance, or thickened so as to be viscous to give a high raised appearance where desired.

In the preferred embodiment, the plastisol is applied by being pressed through openings in a silk screen. The plastisol flows freely through the screen openings and will not clog them, thereby assuring that the screen can be re-used. The openings may have extremely fine detail and, hence, the adhesive pattern can be likewise very detailed. The pattern thus defines areas on the base layer to be glittered. Any pattern is intended to be covered by this invention.

A multitude of light-reflective particles or glitter flakes 16, each coated with an adhesive substance 18, is to be deposited or flocked onto these areas. In the preferred embodiment, a roll of a light-reflective material, such as a polyester foil, is unrolled and at least one surface, if not both surfaces, are coated with an adhesive substance, preferably a particulate adhesive, such as a powdered resin. A linear saturated polyester resin is useful for this purpose and is ground to a fine powder.

Thereupon, the powdered adhesive coating is fixed to the foil. In the preferred embodiment, the coating is exposed to a temperature of about 250°–300°to F. for a time of about 20–60 seconds to cause the coating to melt and thereupon to cool and solidify in situ on the foil surface. The cooled coating is transparent so as not to interfere with the light-reflective quality of the foil. A transparent coating may overlay the foil prior to being coated with the powdered adhesive. The cooled coating is not tacky, thus enabling the foil to be rolled up and transported to a cutting station, in which the foil is cut and chopped into lightweight, two dimensional, planar, thin, e.g., on the order of 1 mil, and small, e.g., on the order of ⅛ of an inch, flakes.

The flakes are relatively soft so that they can be cut or sewn through and will not scratch a wearer. They are also durable enough to maintain their shape throughout their life and can be washed at normal temperatures. The flakes are relatively light so that a large number may be placed on a piece of the base layer 12 without unduly weighing it down. Any combination of colors, shapes and/or sizes of flakes may be utilized on a single piece of base layer as desired.

The flakes are flocked onto the adhesive-coated pattern on the base layer by hand or by using a suitable sieve. The flakes stick to the wet, tacky, adhesive-coated areas, and a pattern of flakes corresponding to the pattern of the adhesive is laid down on the base layer. The flakes cover up the plastisol to a large extent so that the plastisol does not show through. All of these features make the finished decorative article suitable for a wide variety of uses.

After the flakes are applied to the base layer, the excess flakes which did not initially adhere to the base layer are removed, for example, by shaking the base layer or by using air or gas to blow off the excess flakes. Preferably, a vacuum cleaner or analogous suction device picks up the excess flakes. Only the excess flakes are removed, and the remaining flakes contact the plastisol for adherence to the base layer 12.

In order to firmly fix the flakes to the base layer, the plastisol is heated to its curing point, i.e., the temperature at which the polyvinylchloride particles in the plastisol solidify. This is accomplished by placing the base layer on a heated plate, or by placing it in an oven, or by using infrared heating lamps, or by using any other suitable heating means. All of the plastisols described above have a heat curing temperature in the range of between 300° F. to about 400° F., and all will adhere firmly to a fabric or other porous material. It is preferred that a plastisol which cures at 300° F. and above be used.

In accordance with this invention, the heat used to cure the plastisol is also used to melt the adhesive substance 18 on the flakes and cause the adhesive substance to become tacky. Adjoining flakes then adhere to one another. Hence, after cooling, the flakes are not only fixed to the cured plastisol, but are also fixed to one another.

The adherence between adjoining flakes that contact each other reduces the tendency of the flakes to scatter off the base layer, and minimizes the amount of excess flakes to be removed from the base layer, as well as the number of flakes that fall off the base layer. More flakes than heretofore occupy each area of the base layer to be glittered. The result is a very full coverage of each area. The finished article simulates the appearance of expensive, metal-ornamented fabrics.

Turning now to FIG. 1, the method of making the article 10 includes performing the step 20 in which the light-reflective foil is coated with an adhesive substance 18, performing the step 22 in which the adhesive substance 18 is fixed on the foil to form an adhesive-coated foil, and performing the step 24 in which the adhesive-coated foil is formed into a multitude of glitter flakes 16.

The method further includes the step 26 of applying the curable adhesive 14 in a predetermined pattern on areas of the fabric base material 12 to be glittered; and the step 28 of depositing the glitter flakes 16 onto the areas of the base material 12.

Still further is the performance of the step 30 in which heat is used to cure the adhesive 14, while concomitantly causing the adhesive substance 18 to become tacky and cause adhesion between contacting flakes 16. Scattering and fall off of the flakes is thus minimized.

It will be understood that each of the elements described aobve, or two or more together, also may find a useful application in other types of constructions differing from the types described above.

While the invention has been illustrated and described as embodied in decorative glittered articles and a method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalents of the following claims.

What is claimed as new and desired to be protected by letters patent is set forth in the appended claims:

I claim:

1. A method of making a decorative article with fully glittered areas, comprising the steps of:

a) coating a light-reflective foil with an adhesive substance;

b) fixing the adhesive substance on the foil to form an adhesive coated foil;

c) forming the adhesive-coated foil into a multitude of glitter flakes having outer surfaces coated with the fixed adhesive substance;

d) applying a curable adhesive in a predetermined pattern on areas of a base material to be glittered;

e) depositing the glitter flakes onto the areas of the base material; and f) curing the curable adhesive with heat and concomitantly causing the adhesive substance on mutually contacting outer surfaces of the glitter flakes to become tacky and adhere the mutually contacting outer surfaces of the glitter flakes to one another.

2. The method of claim 1, wherein the coating step is performed by coating at least one surface of the foil with a particulate adhesive substance.

3. The method of claim 2, wherein the particulate adhesive substance is a powdered resin.

4. The method of claim 2, wherein the fixing step is performed by heating the particulate adhesive substance to a temperature and for a time sufficient to cause the substance to flow and solidify in situ on the foil.

5. The method of claim 1, wherein the forming step is performed by cutting the coated foil into miniature, flat, thin pieces.

6. The method of claim 1, wherein the applying step is performed by applying a layer of tacky plastisol on the base material.

7. The method of claim 1, wherein the depositing step is performed by flocking the glitter flakes onto the base material.

8. The method of claim 1, wherein the curing step is performed by exposing the glitter flakes to a temperature and for a time sufficient to cause the adhesive substance on the mutually contacting outer surfaces of the glitter flakes to flow and fuse together.

9. A decorative article with fully glittered areas, comprising:

a) a base material;

b) a cured adhesive on areas of the base material to be glittered;

c) a multitude of glitter flakes fully covering each area, each glitter flake including a light-reflective foil having an outer surface coated with an adhesive substance, the adhesive substances on adjoining outer surfaces of the glitter flakes being adhered and fused to one another, the glitter flakes being adhered to the curable adhesive.

* * * * *